United States Patent [19]

Hasircoglu

[11] Patent Number: 4,874,319

[45] Date of Patent: Oct. 17, 1989

[54] TERMINAL LEAD SHIELDING FOR HEADERS AND CONNECTORS

[75] Inventor: Alexander W. Hasircoglu, Lancaster, Pa.

[73] Assignee: E. I. Du Pont de Nemours and Company, Wilmington, Del.

[21] Appl. No.: 222,090

[22] Filed: Jul. 20, 1988

[51] Int. Cl.[4] ..... H01R 4/66

[52] U.S. Cl. ..... 439/108; 439/608

[58] Field of Search ..... 439/92, 95, 101, 108, 439/607–609

[56] References Cited

U.S. PATENT DOCUMENTS

| | | | |
|---|---|---|---|
| 4,005,921 | 2/1977 | Hadden et al. | 339/14 |
| 4,025,141 | 5/1977 | Thelissen | 339/99 |
| 4,232,929 | 11/1980 | Zobawa | 439/607 |
| 4,568,136 | 2/1986 | Reuss | 439/629 |
| 4,601,527 | 7/1986 | Lemke | 339/14 |
| 4,606,596 | 8/1986 | Whiting et al. | 339/107 |
| 4,624,515 | 11/1986 | Brush, Jr. et al. | 339/14 R |
| 4,655,518 | 4/1987 | Johnson et al. | 339/17 |
| 4,686,607 | 8/1987 | Johnson | 361/413 |
| 4,687,263 | 8/1987 | Cosmos et al. | 439/108 |
| 4,734,042 | 3/1988 | Martens et al. | 439/62 |
| 4,737,116 | 4/1988 | Slye et al. | 439/607 |

FOREIGN PATENT DOCUMENTS

| | | | |
|---|---|---|---|
| 0002890 | 7/1979 | European Pat. Off. | 439/608 |
| 0090539 | 5/1983 | European Pat. Off. . | |
| 8707444 | 12/1987 | PCT Int'l Appl. | 439/608 |

OTHER PUBLICATIONS

Exhibit A–Teradyne Connection Systems, Inc., 'High Density Plus One'.

*Primary Examiner*—Gary F. Paumen

[57] ABSTRACT

A multi-row right-angle type header is mounted upon a printed circuit board and includes a series of leaf-type spring contacts positioned on opposite sides of the pin field and are designed to effect electrical connection with the conductive shroud of the connector telescopically received within the housing. The spring contacts each include respective tail portions that extend rearwardly of the housing and are connected to the printed circuit board in such a way that the adverse effects of electric fields is attenuated. In another form of the invention, a shield structure is connected to the tail portions of the spring contacts to provide an additional increment of shielding. The present invention advantageously provides for the shielding of the terminal leads of headers and connectors in the context of right-angle mountings so as to attenuate electric field radiation from and between the various circuits and attenuate the effect of external fields on those circuits in a cost-effective manner.

23 Claims, 3 Drawing Sheets

10'
50
52
56
6
42
44
58
60
62
64
66
68
6B
T1

TERMINAL LEAD SHIELDING FOR HEADERS AND CONNECTORS

BACKGROUND OF THE INVENTION

The present invention relates to the electrical and mechanical mounting of electrical headers and connectors to printed circuit boards in such a way that electric field propagation from the individual signal carrying conductors is minimized.

Electrical connectors and headers are used to effect electrical connection to and from printed circuit boards and typically include a housing and an array of receptacles or pins supported in the housing for mating connection with a similar array of pins or receptacles of the corresponding header or connector. Each pin or receptacle includes a "tail" portion that extends from the housing to define an array of tail portions that are designed to be received within and passed through an array of holes on the printed circuit board. The tail portions can extend rearwardly in a straight-line fashion from the housing or can be bent at a right angle relative to the principal mating axis of the contact pair.

In many electronic systems, it is important that the various interconnected circuits be shielded or otherwise protected from external electric fields and, conversely, that any electric fields developed from those circuits be prevented from propagating to other circuits. The problem is of particular concern in signal-bus applications in which higher bus speeds and the attendant signal transitions cause electromagnetic interference that can adversely affect adjacent circuits. Headers that use straight-back tail portions are typically mounted upon the printed circuit board so that the tail portion length, and its attendant antenna effect, is minimal. The situation is somewhat different with regard to right-angle mounting arrangements since the tail portions extend rearwardly from the housing and then extend at a right angle to provide a substantially longer tail portion in which the segment lengths can provide a measure of wavelength-matching at certain signal speeds.

While the straight-back approach provides a minimum tail length and minimal consequent antenna effect, the design is not well suited for use in card-cage type packaging systems which printed circuit boards are mounted in closely adjacent positions. In traditional circuit board designs, electromagnetic interference can be addressed by providing a full-shield housing or other shield structure to prevent electric field emission and provide a measure of protection against external radiation. While shielding can prevent radiation from emanating from a signal carrying set of circuit conductors, it oftentimes represents an extra cost increment not consistent with cost-effective connector systems. In addition, shielding oftentimes does not address the problem of inter-circuit interference between or among the various tail portions. Accordingly, a need arises for a cost-effective technique which prevents or at least attenuates radiation from signal carrying circuits and prevents those circuits from being adversely affected by external fields.

SUMMARY OF THE INVENTION

In view of the above, it is an object of the present invention, among others, to provide terminal lead shielding for headers and connectors which serves to attenuate the electrical field emission from signal-carrying circuits connected between a header or connector and a printed circuit board.

It is another object of the present invention to provide terminal lead shielding for headers and connectors to provide a measure of shielding to attenuate adverse effects of external electric fields on the signal-carrying circuits connected between the header or connector and the printed circuit board.

It is still another object of the present invention to provide terminal lead shielding for headers and connectors in which a measure of inter-circuit shielding is provided between the signal-carrying circuits of a header or connector and the printed circuit board upon which it is mounted.

In view of these objects, and others, the present invention provides terminal lead shielding for headers and connectors between the header and/or connector and its printed circuit board in which electric field radiation from the various circuits is attenuated and in which the effect of external electric fields is likewise attenuated. In the context of a multi-row header mounted upon a printed circuit board and in accordance with the present invention, a series of leaf-type spring contacts are mounted on opposite sides of the pin field and are designed to effect electrical connection with the conductive shroud of the connector that is telescopically received within the housing. The spring contacts each include respective tail portions that extend rearwardly of the housing and are connected to the printed circuit board in such a way that the adverse effects of electric fields is attenuated. In another form of the invention, a shield structure is connected to the tail portions of the spring contacts to provide an additional increment of shielding.

The present invention advantageously provides for the shielding of the terminal leads of headers and connectors in the context of right-angle mountings so as to attenuate electric field radiation from and between the various circuits and attenuate the effect of external fields on those circuits in a cost-effective manner.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figures 1, 1A:
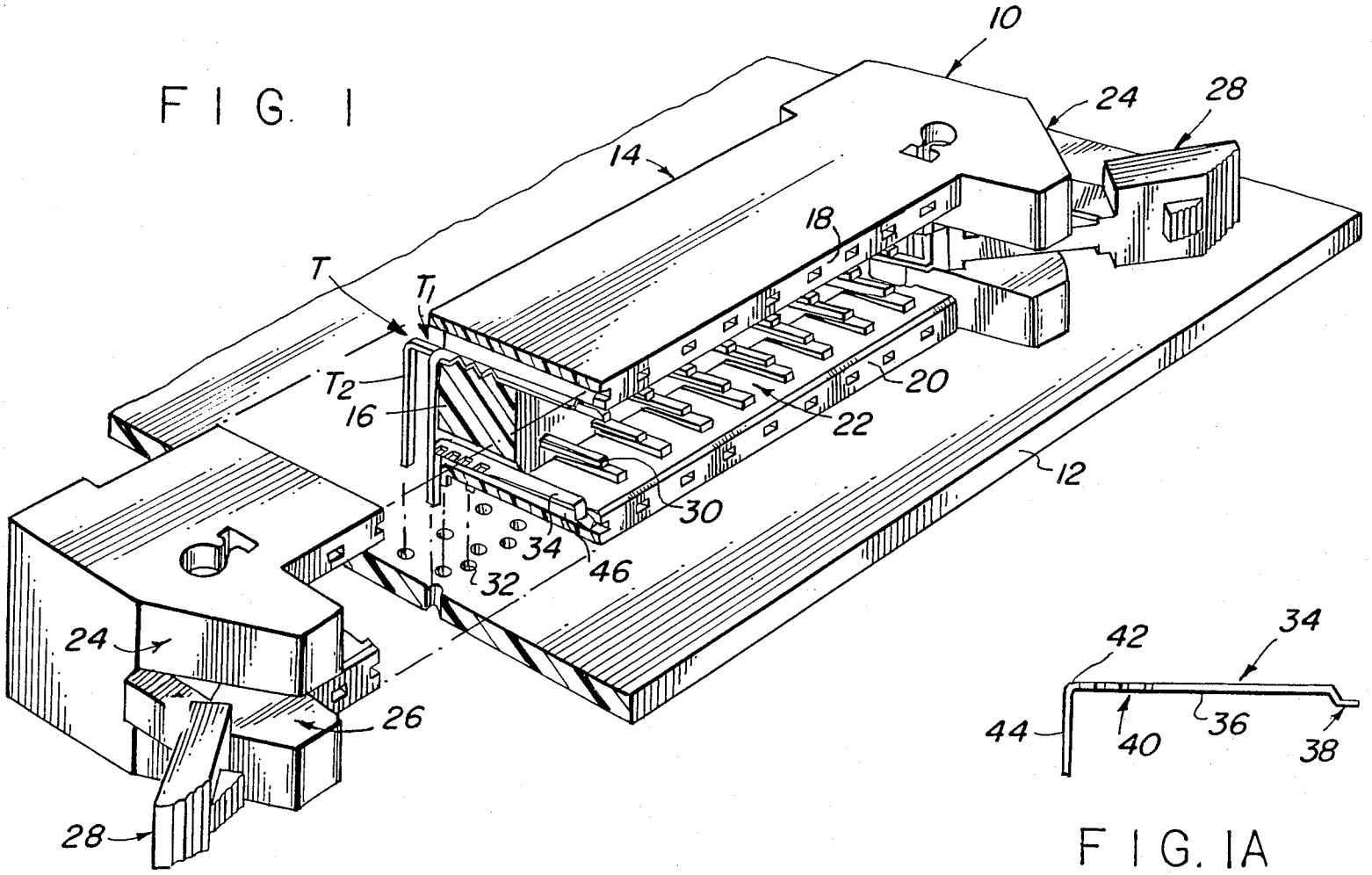
FIG. 1 is a rear perspective view of an exemplary right-angle ejection latch header mounted upon a printed circuit board in which selected portions have been cut away for reasons of clarity.
FIG. 1A is a side view of a spring contact used with the header of FIG. 1.

An exemplary right-angle mounted header in accordance with the present invention is illustrated in perspective view in FIG. 1 and designated generally therein by the reference character 10. As shown, the header 10 is mounted on the side of a printed circuit board 12 and includes a housing 14, typically fabricated from a molded thermoplastic material, and includes a base 16 and first and second spaced apart walls 18 and 20 that define a cavity or recess 22 which receives a mating connector (not shown). The opposite ends of the housing 14 are provided with forwardly extending projections 24, each of which includes a slot 26. A finger-operable latch 28 is pivotably retained in each slot 26 and is movable between a first, eject position (shown in FIG. 1) and a second position. Movement of the latches 28 from the second position towards the first position causes the latches 28 to eject and disconnect a mating connector received within the recess 22. The exemplary header 10 of FIG. 1 is provided with two parallel rows of contacts, typically square-sided or cylindrical pins 30, arranged in a rectangular matrix or array pattern and which are secured within the base 16 and extend forwardly into the recess 22 for engagement with the receptacles (not shown) of a mating connector. The pins 30 each include a tail portion, generally designated by the reference character T, that extends rearwardly of the housing 14 for effecting electrical connection with the printed circuit board 12. Each tail portion T includes a first segment $T_1$ that extends linearly and rearwardly from its pin 30 and a second segment $T_2$ that extends at an angle, typically a right angle, relative to the first segment $T_1$ and which extends through a suitable through bore 32 formed in the printed circuit board 12. The header 10 is available under part number designation 66429-XXX from DuPont Electronics of New Cumberland, PA 17070.

The header 10 is provided with a series of ground-path spring contacts 34 that serve to establish electrical contact with a conductive shroud or shield of the mating connector as is conventional in the art. As shown in FIG. 1 and the side view of FIG. 1A, each spring contact 34 includes a beam portion 36, a distal end 38, a stem portion 40, and a tail portion that includes a first segment 42 that is generally in line with and extends rearwardly from the beam portion 36, and a second segment 44 that extends at a right angle relative to the first segment 42. The spring contacts 34 are typically stamped or pressed from a beryllium-copper alloy.

As shown in the cut-away section of FIG. 1, the facing surfaces of the walls 18 and 20 of the housing are provided with respective grooves 46 for accepting the spring contacts 34. Each groove leads to an interior passageway (unnumbered) in the base 16 of the housing 14 from which the segment 42 extends in the rearward direction. The stem portion 40 includes various retention barbs or spurs (unnumbered) that engage the sides of the interior passageway to retain the spring contact 34 in place. The various spring contacts 34 thus define an upper series or row of spaced apart spring contacts 34 above the array of pins 30 and a complementary lower row of spaced apart spring contacts 34 below the array of pins 30. As can be appreciated, the grooves in which the spring contacts 34 are positioned provide sufficient clearance to allow the beam portion to be resiliently biased toward the pins 30.

Figure 3:
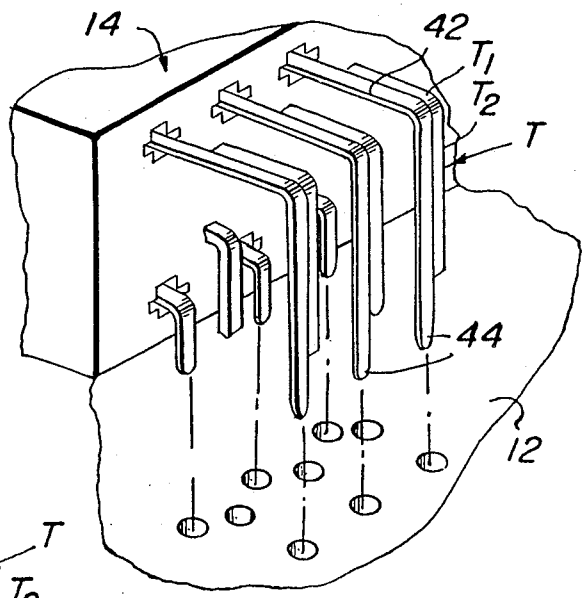
FIG. 3 is similar to that shown in FIG. 2 and illustrates a second tail portion connection configuration in accordance with the present invention.
Figure 4:
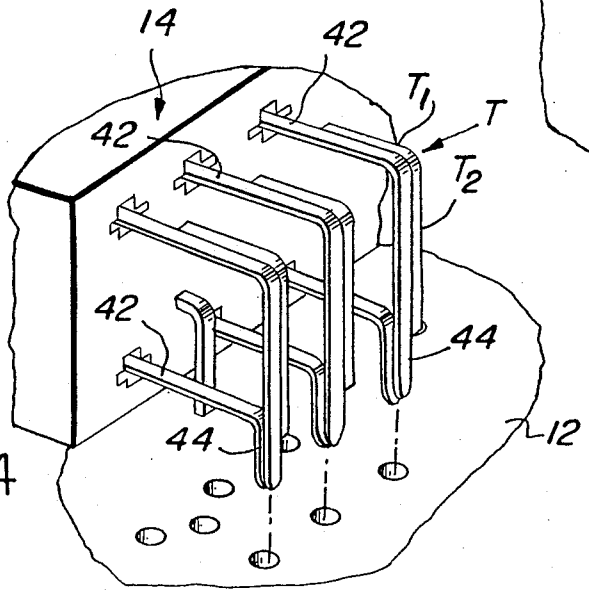
FIG. 4, similar to FIGS. 2 and 3, illustrates a third tail portion connection arrangement in accordance with the present inventin.
Figure 2:
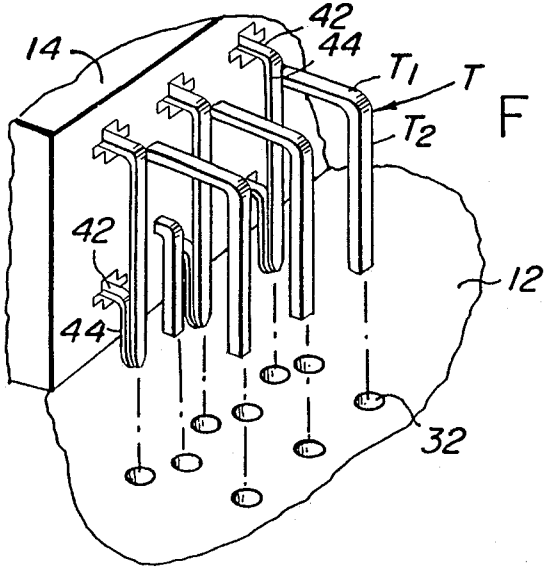
FIG. 2 is a partial rear perspective view of the ejection latch header of FIG. 1 illustrating a first tail portion connection arrangement.

The tail portions T of the various pins 30 and the segments 42 and 44 of the spring contacts 34, as shown in the FIGS. 2, 3, and 4, extend from the rear of the housing 14 with the tail portions of the spring contacts 34 arranged between or intermediate those of the pins 30. As explained below, the various tail portions of the pins 30 and contacts 34 are connected to the printed circuit board 12 to minimize electric field radiation from the various signal-carrying circuits, and, conversely, minimize the adverse affect of external electric fields on the signal-carrying circuits.

As shown in FIG. 2, the first segments $T_1$ of the tail portions of the lower row of pins 30 extend rearwardly from the housing 14 and are bent downwardly at a right angle with respective segment $T_2$ extending through a corresponding hole 32 in the printed circuit board 12. In a similar manner, the first segments $T_1$ of the uppermost row of pins 30 extend a selected distance rearwardly of the housing 14 and are then bent downwardly at a right angle with the respective segment $T_2$ extending through their respective holes 32 in the printed circuit board 12. As can be appreciated, the segments $T_1$ for the tail portions T of the uppermost row of pins 30 are longer than the corresponding segments $T_1$ for the lower row of pins 30 in order to provide sufficient front-to-rear spacing between the descending segments $T_2$ of the upper and lower rows of pins 30.

In a somewhat analogous manner, the first segments 42 of the upper row of spring contacts 34 extends rearwardly a selected distance from the housing 14 and are bent downwardly at a right angle with the second segments 44 extending into holes 32 in the printed circuit board 12. Likewise, the first segments 42 of the lower row of spring contacts 34 extends rearwardly from the housing 14 and are bent downwardly at a right angle so the second segments 44 extend into respective holes 32 in the printed circuit board 12. As shown in FIG. 2, the first segments 42 for both the uppermost and lowermost rows of the spring contacts 34 extend an identical or near identical distance from the rear of the housing 14 so that the second segment 44 of the uppermost row and the second segment 44 of the lowermost row engage each other in adjacent planes and pass through the same hole 32 in the printed circuit board. Thus, each column of pins 30 provides tail portions T that are interdigitated with the first segments 42 and the second segments 44 of the spring contacts 34. It has been found that the interdigitated arrangement of the first segments and second segments of the spring contacts 34 as described above and as shown in FIG. 2 minimizes or at least greatly attenuates electric field radiation from the intermediate signal-carrying tail portions and, conversely, minimizes adverse effects on the signal-carrying circuits from external fields.

A first variation of the configuration of FIG. 2 is illustrated in FIG. 3, and, as shown therein, the tail portions T of the various pins 30 are arranged in a manner identical to that shown in FIG. 2 with the first segments $T_1$ extending rearwardly from the housing 14 and with the second segments $T_2$ extending at a right angle and downwardly to and through respective holes 32 in the printed circuit board 12. The first segments 42 and second segments 44 of the lower row of spring contacts 34 are configured identically to that of FIG. 2, that is, the first segments 42 extend a selected distance rearwardly from the housing 14 and then are bent at a right angle downwardly with the second segments 44 extending into respective receiving holes 32 in the printed circuit board 12. In contrast to the configuration of FIG. 2, the first segments 42 of the upper row of spring contacts 34 extend a substantially greater distance rearwardly than the first segments 42 of the lowermost row and, additionally, the first segments $T_1$ of the uppermost row of pins 30. The second segments $T_2$ are then directed at a right angle downwardly into respective receiving holes 32 in the printed circuit board 12. Accordingly, the second segments 44 of the upper and lower row of spring contacts 34 are spaced front-to-rear from one another in a manner analogous to that of the various second segments $T_2$ of the various tails T.

A second variation of the configuration of FIG. 2 is illustrated in FIG. 4, and, as shown therein, the tail portions T of the various pins 30 are arranged in a manner identical to that shown in FIGS. 2 and 3 with the first segments $T_1$ extending rearwardly from the housing 14 and with the second segments $T_2$ extending at a right angle and downwardly to and through respective holes 32 in the printed circuit board 12. The first segments 42 and second segments 44 of the upper row of spring contacts 34 are configured identically to that of FIG. 3, that is, the first segments 42 extend a selected distance rearwardly from the housing 14 and then are bent at a right angle downwardly with the second segments 44 extending into respective receiving holes 32 in the printed circuit board 12. In contrast to the configuration of FIG. 2, the first segments 42 of the lower row of spring contacts 34 extend a similar distance rearwardly as the first segments 42 of the upper row of pins 30. The second segments $T_2$ are then directed at a right angle downwardly into respective receiving holes 32 in the printed circuit board 12, these holes 32 being the same that accommodate the second segments 44 of the upper row of pins. Accordingly, the second segments 44 of the upper and lower row of spring contacts 34 are generally rearward of the second segments $T_2$ of the pin contacts.

As can be appreciated from the above, the configurations of FIGS. 2, 3, and 4 serves to position a number of grounded, conductive first and second segments 42 and 44 in an interdigitated fashion with the signal carrying tail portions T. It has been found that the presence of the first and second segments 42 and 44 serves to attenuate electric field emission from the individual signal-carrying circuits as well attenuate the effect of external fields on the signal carrying conductors in a cost-effective manner.

Figures 5, 6, 6A, 6B:
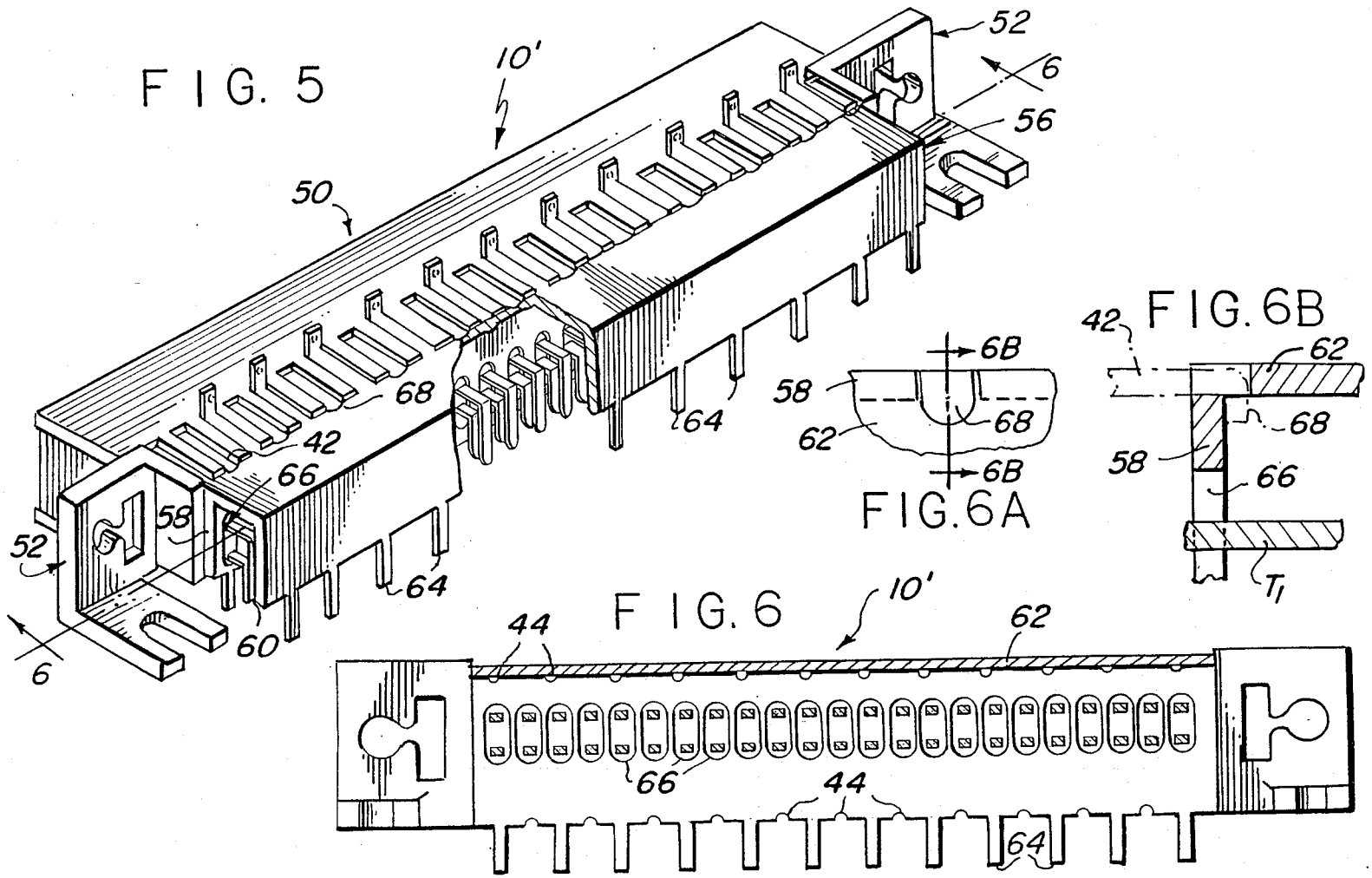
FIG. 5 is a rear perspective view of another right-angle mounting which includes a shield member for attenuating electric field radiation from and to the tail portions.
FIG. 6 is a rear elevational view, in cross-section, of the header of FIG. 5 taken along line 6—6 of FIG. 5.
FIG. 6A is an enlarged detail view of the connector of FIG. 5.
FIG. 6B is a side view, in cross section, of the view of FIG. 6A taken along line 6B—6B.

A second variation of the header configuration of FIG. 1 is shown in FIGS. 5 and 6, and, as shown, the header 10' includes a molded thermoplastic housing 50 having a mounting bracket 52 extending laterally from each end for mounting the header 10' upon a printed circuit board (not shown in FIGS. 5–6). The header 10' includes a base and side wall structure as described above in connection with FIG. 1 and includes upper and lower rows of pins (not shown) having tail portions $T_1$ that extend rearwardly of the housing 50 and tail portions $T_2$ that are bent downwardly at a right angle as described above in relationship to FIGS. 2, 3, and 4. The header 10' additionally includes a set of upper row and lower row spring contacts (not specifically shown) each of which includes a first segment 42 and a second segment 44 that cooperate with a shield 56 that surrounds the tail portions $T_1$ and $T_2$. The shield 56 is fabricated from a stamped or pressed conductive sheet stock, and, as shown in FIG. 5, includes spaced parallel side walls 58 and 60 connected by a contiguous top 62 with a series of spaced depending lugs 64 extending from the lower edge of each side wall 58 and 60. The lugs 64 are designed to be received within appropriate receiving bores in the printed circuit board and soldered in place, with the lugs typically making contact with appropriate ground traces or a ground plane fabricated as part of the printed circuit board. As best shown in FIG. 6, the side wall 58 is provided with a series of adjacent, vertically elongated openings 66 through which the segments $T_1$ of the various tail portions of the upper and lower rows of pins extend. The top wall, at the intersection of the side wall 58, as best shown in FIGS. 6A and 6B, are provided with a series of spaced semicircular cut-outs 68 that are in alignment with the first segments 42 of the upper row of spring contacts. The rearwardly extending first segments 42 of the various spring contacts of the upper row extend over the top of the side wall 58 at each cut-out 68 with the second segments 44 bent downwardly at a right angle to crimp and thereby secure the side wall 58 against the rear of the header housing 50. The lower edge of the side wall 58 is similarly crimped with the second segments 44 of the lower row of spring contacts. As can be appreciated, the spring contacts of the upper and lower rows are used to effectively secure the shield 56 to the rear of the housing and provide both mechanical and electrical connection with the spring contacts.

The invention has been described above in the context of two-row headers utilizing pins mounted in a housing; as can be appreciated, the invention is equally suited to headers using more or less than two rows of contacts as well as connectors utilizing receptacles mounted in a housing.

As will be apparent to those skilled in the art, various changes and modifications may be made to the illustrated terminal lead shielding for headers and connectors of the present invention without departing from the spirit and scope of the invention as determined in the appended claims and their legal equivalent.

What is claimed is:

1. An electrical connection device comprising:

a housing having at least one row of spaced apart electrical contacts for effecting connection with respective contacts of a complementary type, each said electrical contact having a tail portion having a first segment extending in a rearward direction from said housing and a second segment extending at an angle in a selected direction relative to its first segment;

a first row of spaced apart ground contacts on one side of said row of electrical contacts and a second row of spaced apart ground contacts on the other side of said row of electrical contacts, each said ground contact having a tail portion having a first segment extending in a rearward direction from said housing and a second segment extending at an angle in the selected direction relative to its first segment, the respective tail portions of said first and second rows of ground contacts arranged intermediate said tail portions of each of said electrical contacts, and wherein respective said second segments of said tail portions of said electrical contacts and said ground contacts extend at a substantially right angle relative to their respective said first segments.

2. The electical connection device of claim 1, wherein said housing has at least two rows of said electrical contacts, said contacts arranged in a rectangular array.

3. The electrical connection device of claim 1, wherein said first segments of said first and second row of ground contacts are of substantially the same length.

4. The electrical connection device of claim 3, wherein said second segments of said first row of ground contacts are in electrical contact with corresponding ones of said second segments of said second row of ground contacts.

5. The electrical connection device of claim 1, wherein the length of said first segments of said first and second row of ground contacts are substantially the same length and less than the length of said first segments of said electrical contact tail portions.

6. The electrical connection device of claim 5, wherein said second segments of said first row of ground contacts are in electrical contact with corresponding ones of said second segments of said second row of ground contacts.

7. The electrical connection device of claim 1, wherein the length of said first segments of said first and second rows of ground contacts are substantially the same length and greater than the length of said first segments of said electrical contact tail portions.

8. The electrical connection device of claim 7, wherein said second segments of said first row of ground contacts are in electrical contact with corresponding ones of said second segments of said second row of ground contacts.

9. The electrical connection device of claim 1, wherein the length of said first segments of said first row of ground contacts is less than the length of said first segments of said electrical contact tail portions and the length of said first segments of said second row of ground contacts is greater than the length of said first segments of said electrical contact tail portions.

10. The electrical connection device of claim 1, further comprising:

a shield member mounted to said housing, said shield member having at least first and second spaced sidewalls connected by a top wall and mechanically connected at said first wall to said first and second segments of said ground contacts to secure said shield member to said housing.

11. The electrical connection device of claim 10, wherein said first and second segments of said ground contacts crimp said shield member to said housing.

12. The electrical connection device of claim 11, wherein said first wall includes apertures therein through which said tail portions of said electrical contacts extend.

13. A right-angle header for mounting to a printed circuit board, comprising:

a housing having at least one row of spaced apart pins for effecting connection with respective electrical contacts of a complementary type, each pin including a tail portion having a first segment extending in a rearward direction from said housing and a second segment extending at a substantially right angle in a selected direction relative to its first segment;

a first row of spaced apart ground contacts on one side of said row of pins and a second row of spaced apart ground contacts on the other side of said row of pins, each said ground contact having a tail portion having first segment extending in a rearward direction from said housing and a second segment extending at a substantially right angle in the selected direction relative to its first segment, the respective tail portions of said first and second rows of ground contacts arranged intermediate said tail portions of each of said pins.

14. The right-angle header of claim 13, wherein said housing has at least two rows of said pins, said pins arranged in a rectangular array.

15. The right-angle header of claim 13, wherein said first segments of said first and second rows of ground contacts are of substantially the same length.

16. The right-angle header of claim 15, wherein said second segments of said first row of ground contacts are in electrical contact with corresponding ones of said second segments of said second row of ground contacts.

17. The right-angle header of claim 13, wherein the length of said first segments of said first and second rows of ground contacts are substantially the same length and less than the length of said first segments of said electrical contact tail portions.

18. The right-angle header of claim 17, wherein said second segments of said first row of ground contacts are in electrical contact with corresponding ones of said second segments of said second row of ground contacts.

19. The right-angle header of claim 18, wherein the length of said first segments of said first and second rows of ground contacts are substantially the same length and greater than the length of said first segments of said electrical contact tail portions.

20. The right-angle header of claim 19, wherein said second segments of said first row of ground contacts are in electrical contact with corresponding ones of said second segments of said second row of ground contacts.

21. The right-angle header of claim 20, wherein the length of said first segments of said first row of ground contacts is less than the length of said first segments of said electrical contact tail portions and the length of said first segments of said second row of ground contacts is greater than the length of said first segments of said electrical contact tail portions.

22. The right-angle header of claim 13, further comprising:

a shield member mounted to said housing, said shield member having at least first and second spaced sidewalls connected by a top wall and mechanically connected at said first wall to said first and second segments of said ground contacts to secure said shield member to said housing.

23. The right-angle header of claim 22, wherein said first and second segments of said ground contacts crimp said shield member to said housing.

* * * * *